United States Patent [19]

Pelligrino

[11] Patent Number: 4,836,809

[45] Date of Patent: Jun. 6, 1989

[54] CONTROL MEANS FOR MARINE PROPULSION SYSTEM

[75] Inventor: Paul A. Pelligrino, Rockford, Ill.

[73] Assignee: Twin Disc, Incorporated, Racine, Wis.

[21] Appl. No.: 166,702

[22] Filed: Mar. 11, 1988

[51] Int. Cl.[4] ..... B63H 21/21

[52] U.S. Cl. ..... 440/2; 440/84; 440/86; 440/87

[58] Field of Search ..... 114/146; 440/1, 2, 75, 440/84, 86, 87; 74/DIG. 8

[56] References Cited

U.S. PATENT DOCUMENTS

| | | | |
|---|---|---|---|
| 2,406,264 | 8/1946 | Stevens | 74/DIG. 8 X |
| 2,925,156 | 2/1960 | Grant et al. | 74/DIG. 8 X |
| 4,739,236 | 4/1988 | Burkenpas | 440/2 X |

FOREIGN PATENT DOCUMENTS

| | | | |
|---|---|---|---|
| 0126796 | 8/1982 | Japan | 440/84 |
| 0105796 | 5/1987 | Japan | 440/84 |

*Primary Examiner*—Sherman D. Basinger
*Attorney, Agent, or Firm*—James E. Nilles; Thomas F. Kirby

[57] ABSTRACT

A marine vessel propulsion system includes port and starboard drive systems, each including an engine, an engine throttle, and a transmission furnishing drive power to a propeller on a drive shaft. Each transmission includes forward and reverse clutches, and each clutch can be fully engaged, fully disengaged and modulated. Two alternately usable separate control stations operate the throttles and clutches to control vessel speed and direction. Each control station comprises port and starboard sets of manually operable control devices, and each set includes a mode selector switch for selecting cruise mode or troll mode for its respective throttle and a manually operable direction/speed control lever. In troll mode the lever selects and modulates the selected respective clutch to control propeller speed. In cruise mode the lever fully engages the selected respective clutch and also regulates the engine throttle to control propeller speed. Port and starboard manually operable power-link function selector switches at each control station enable one direction/speed control lever to control both drive systems simultaneously in the forward cruise mode. Electronic controllers process control station output signals and feedback signals indicative of engine speeds and propeller direction and speeds and then provide drive system control signals. Transfer of control to one station from another is possible.

19 Claims, 4 Drawing Sheets

CONTROL MEANS FOR MARINE PROPULSION SYSTEM

BACKGROUND OF THE INVENTION

1. Field of Use

This invention relates generally to control means for a marine propulsion system of a vessel, such as a boat, ship or the like.

In particular it relates to a marine propulsion system comprising a plurality of drive systems (such as port and starboard), each of which drive systems comprises an engine having an engine throttle, a transmission having forward and reverse clutches, and a propeller shaft with a propeller thereon which is connectable to the engine by the transmission clutches. The control means comprises one or more control stations locatable at desired navigation positions aboard the vessel, and each control station comprises a plurality of sets (such as port and starboard sets) of manually operable control devices, one set for each drive system, to control the engine throttle and clutches therein.

2. Description of the Prior Art

Some prior art marine propulsion systems comprise port and starboard drive systems, each of which comprises an engine, an engine throttle to regulate the speed of the engine, a propeller shaft having a propeller thereon and a transmission to connect the engine to the propeller shaft. The transmission includes alternately engageable forward and reverse clutches to enable the propeller to rotate in forward or reverse directions in accordance with the speed of the engine.

Typical prior art control means comprise two duplicate sets of manually operable control devices, one set for each drive system, located on the bridge of the vessel. A set of prior art control devices typically includes a manually actuatable speed control lever for controlling an engine throttle and a manually actuatable direction control lever for controlling the forward and reverse clutches of a transmission.

However, for convenience and safety, some vessels have two duplicate sets of such manually operable control devices, each set located at different command or navigation positions, such as on the main bridge and on the flying bridge or aft deck, to enable command from either position at any given time, either by one or more navigators. In the latter case, transfer of command from one position to another may require the sets of manually operable control devices at one command position to be returned to neutral so as to reduce the speed of both engines to idle and to disengage all clutches before command can be transferred to and assumed at the other position. As a result, the vessel slows down and is literally adrift while transfer occurs. In other cases, it is not possible to take command at another position without first issuing a command-enabling signal from the position currently in command. Obviously, hazardous situations can arise and become aggravated as a result of confusion and delay in transferring command.

Another disadvantage associated with prior art control systems for relatively large marine propulsion systems, is that it may be difficult or impossible to maintain a desired low vessel speed, even at engine idle, because the propeller shaft is coupled to the engine by a fully engaged clutch. In such a case propeller speed necessarily results in a vessel speed of about six to twelve knots, for example. Then, it is impossible to maintain a trolling speed substantially at or below the six knot speed limit often required in no-wake areas without a separate so-called trolling motor on the vessel.

Therefore, it is desirable to provide improved control means for marine propulsion systems to overcome and provide solutions to the problems described above.

SUMMARY OF THE INVENTION

The present invention is especially well-adapted for use in marine propulsion systems aboard a vessel and having multiple drive systems but could be employed in other propulsion systems. For purposes of clarity and ease of understanding, the invention is disclosed herein as embodied in a marine propulsion system having two (port and starboard) drive systems.

Each drive system comprises an engine, an electrically-operated adjustable engine throttle, and a transmission comprising electrically-operated, selectively-engageable, modulatable, forward and reverse clutches for connecting a propeller drive shaft having a propeller thereon to the engine.

The control means in accordance with the invention, which operate the drive systems to control the speed and direction of the vessel through the water, generally comprises, in its simplest form, at least one control station which is located at a fixed command or navigation position aboard the vessel. If preferred, the control station could be fabricated as a portable unit which is adapted to be plugged into electrical connectors located at various command or navigation positions aboard the vessel, each connector being electrically connected to other necessary components of the control means. In a more complex form, shown in the preferred embodiment herein, the control means comprises two alternately usable control stations, designated as main and auxiliary, each located at a different command or navigation position aboard the vessel, and both port and starboard drive systems can be controlled from either control station. However, more than two control stations and more than two drive systems could be provided.

Each control station comprises two duplicate sets of control devices, namely a port set and a starboard set for operating the engine throttle and transmission clutches in the port drive system and starboard drive system, respectively. Each set comprises a mode selector assembly having a manually operable mode selector switch for selecting troll mode or cruise mode; a direction/speed selector assembly having a manually operable direction/speed control lever (hereinafter sometimes referred to as a D/S lever) for controlling propeller shaft speed; and a display assembly having a manually operable display/function selection switch. The latter switch enables the status of various system components and conditions to be visually displayed and also enables a power-link function or mode and a match function to be achieved. The power-link function enables one set of control devices in a control station to effect simultaneous control of both drive systems. The match function enables a set of control devices in a control station taking command to be matched, positionwise, to those in the control station from which command is being taken.

Each control station also comprises a manually operable command station selector switch which is actuatable to transfer control or command to that control station at which the command station switch is located and actuated.

The control devices and command switch provide electric output signals indicative of operations selected by the navigator.

The control means further comprises port and starboard sensing devices, associated with the port and starboard drive systems, respectively, which provide electric feedback signals indicative of engine speed, propeller shaft speed, and other system conditions, such as cooling water level and oil temperature and pressure.

The control means also comprises a master electronic controller and an auxiliary electronic controller which are electrically interconnected to each other. The master controller directly receives and processes the output signals from the port set of control devices of each control station, the command signal from each control station and the feedback signals from the port drive system, and provides control signals to directly regulate the port drive system accordingly. The auxiliary controller directly receives and processes the output signals from the starboard set of control devices of each control station and the feedback signals from the starboard drive system, and provides control signals to directly regulate the starboard drive system accordingly. If preferred, the described arrangement could be reversed.

The main controller is further operable, when the power-link function is selected, to effect simultaneous control of both drive systems in response to output signals from that set of control devices at which the power-link function was selected. If the power-link output signal originates from any port set of control devices, it is received directly by the master controller. If the power-link output signal originates from any starboard set of control devices, the master controller receives message signals to that effect from the auxiliary controller and provides acknowledgment signals to the auxiliary. Thus, the main controller provides control signals directly to the port drive system and provides acknowledgement signals to the auxiliary controller which then provides corresponding control signals to the starboard drive system.

The feedback signals received by the master controller and the auxialiary controller, besides being processed to achieve drive system control, are also used to operate the visual displays of the display assemblies associated with a respective controller.

The invention provides numerous advantages over the prior art. For example, a single control station enables control of the port and starboard drive systems individually by a respective D/S lever and also enables control of both drive systems simultaneously (in forward cruise mode only) by means of only one D/S lever when the power-link function is selected. Each drive system is operable in either a relatively slow troll mode or in relatively faster cruise mode. In troll mode, the D/S lever effects clutch modulation to achieve propeller speeds below the engine idle speed selected for troll mode. In cruise mode, the D/S lever effects full clutch engagement and engine throttle regulation to achieve propeller speeds directly proportional to engine speed. A single control station, if portable, could be plugged into other necessary control means components at any one of several command or navigation positions aboard the vessel. Or, a portable or permanent control station could be provided at each of several command or navigation positions. A command signal is issued from a control station at a navigation position at which command is desired and can be immediately transferred, taking into account the positions of the control devices of the other control station, if the match function is selected. A visual display of the status of certain drive system conditions is readily available to the navigator. The control means can be easily and economically installed in a vessel during manufacture or as a retro-fit. The control means are relatively economical to manufacture and provide redundancy factors and inherent fail-safe features which greatly enhance safe and efficient operation of the vessel. Other objects and advantages of the invention will hereinafter appear.

DESCRIPTION OF A PREFERRED EMBODIMENT

General Arrangement And Basic Operation

Figure 1:
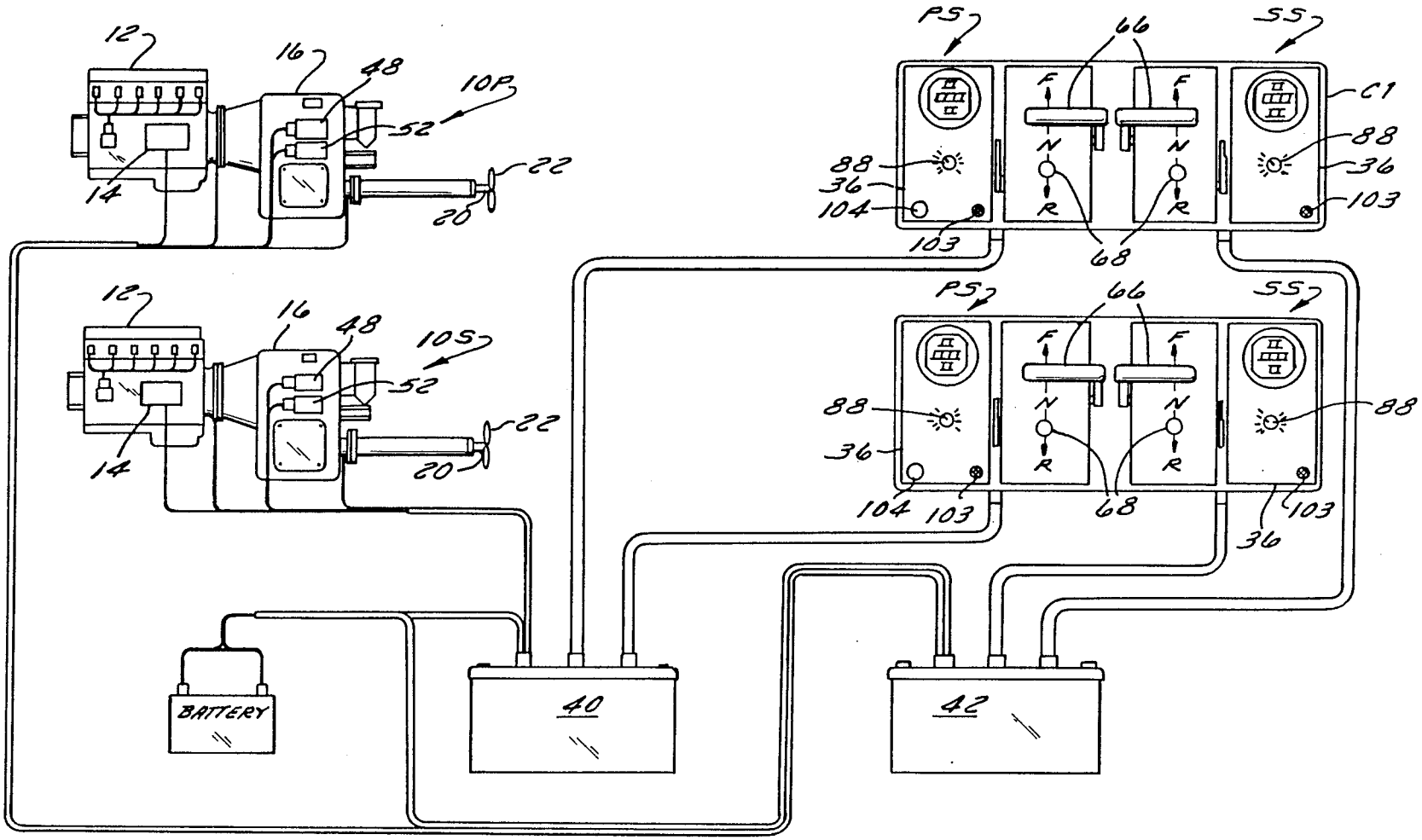
FIG. 1 is a schematic diagram showing components of a marine propulsion system employing control means in accordance with the present invention.
Figure 2:
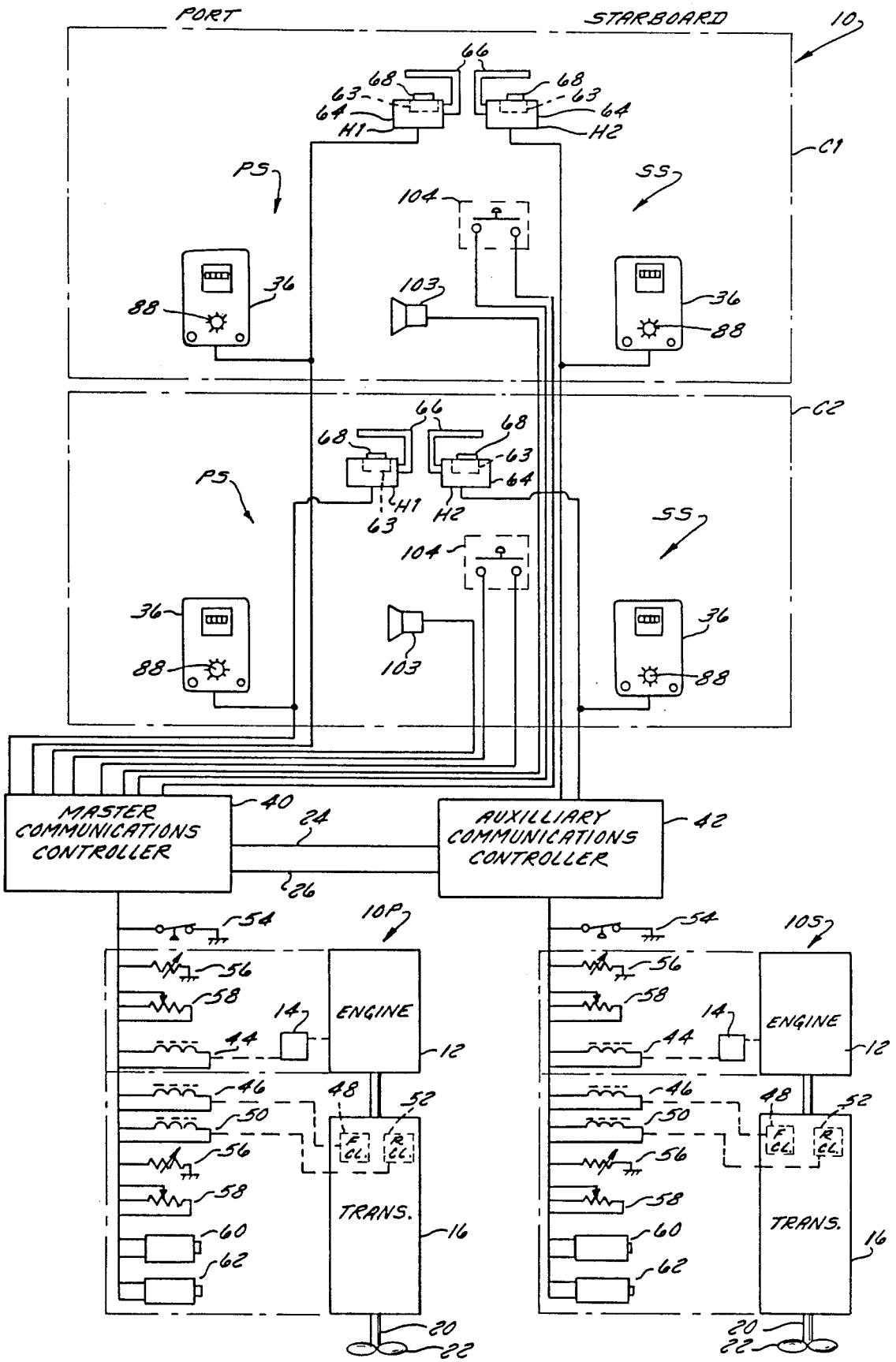
FIG. 2 is a schematic electric circuit diagram of the system shown in FIG. 1.

FIGS. 1 and 2 show a marine propulsion system comprising port and starboard drive systems 10P and 10S and control means for the drive systems to control the speed and direction of a vessel (not shown) through the water.

Each drive system 10P and 10S comprises an engine 12; an electrically operated, adjustable engine throttle 14; and a transmission 16 comprising electrically operated, selectively engageable, modulatable, forward and reverse clutches 48 and 52, respectively, for connecting a propeller drive shaft 20 having a propeller 22 thereon to engine 12.

The control means comprises two alternately usable control stations C1 (main) and C2 (auxiliary) located at separate command or navigation locations on the vessel, such as on the main bridge and on the flying bridge, for example. The navigator can control both port and starboard drive systems 10P and 10S, respectively, from either control station C1 or C2.

Each control station C1 and C2 comprises two duplicate sets of control devices, namely: a port set PS for operating the throttle and clutches in port drive system 10P and a starboard set SS for operating the throttle and clutches in starboard drive system 10S.

Each set PS and SS of control devices comprises a manually operable mode selector assembly 63 having a manually operable mode selector switch knob 68 (for selecting troll mode or cruise mode), a manually operable direction/speed control assembly 64 having a manually operable direction/speed control lever 66, and a display assembly 36 having a manually operable display/function selector switch knob 88 which enables the status of various components and conditions in an associated drive system 10P or 10S to be visually displayed and which also enables a power-link function and a match function to be achieved, as hereinafter described.

Each control station C1 and C2 also comprises a manually operable command station selector switch 104 actuatable to transfer control to that control station at which the command selector switch 104 is located and actuated from the other control station. The assemblies 63, 64 and 36 and command switch 104 provide electric output signals indicative of engine and transmission clutch operations selected by the navigator, as well as other available functions.

The control means further comprises a separate throttle actuator/governor or transducer 44 for the engine throttle 14 of each drive system PS and SS and a separate pair of forward and reverse clutch actuators of transducers 46 and 50, respectively, for the modulatable forward and reverse clutches 48 and 52, respectively, of each drive system PS and SS.

The control means further comprises port and starboard sensing devices, shown in FIG. 2, associated with the port and starboard systems 10P and 10S, respectively, which provide electric feedback signals indicative of engine speed (device 60), propeller shaft speed (device 62), and other system conditions, such as cooling water level (device 54) and oil temperature (device 56) and pressure (device 58).

The control means also comprises a master electronic communications controller 40 and an auxiliary electronic communications controller 42 which are electrically interconnected to each other. Master controller 40 directly receives and processes the output signals from the port sets PS of control device assemblies 63, 64 and 36 of each control station C1 and C2, the command signal from switch 104 at each control station C1 and C2 and the feedback signals from the sensing devices in port drive system 10P, and provides control signals to directly regulate the throttle transducer 44 and clutch transducers 46 and 50 in the port drive system accordingly. Auxiliary controller 42 directly receives and processes the output signals from the starboard sets SS of control devices of each control station C1 and C2 and the feedback signals from the sensing devices in starboard drive system 10S, and provides control signals to directly regulate the throttle transducer 44 and the clutch transducers 46 and 50 in the starboard drive system accordingly.

Master controller 40 is further operable, when the power-link function or mode is selected by actuation of a selector switch knob 68, to effect simultaneous control of both drive systems 10P and 10S in response to output signals from that set of control devices PS or SS at which the power-link function was selected. If the power-link signal originates from any port set PS of control devices, it is received directly by master controller 40. If the power-link signal originates from any starboard set SS of control devices, master controller 40 receives message signals via a line 24 from auxiliary controller 42 and provides acknowledgment signals thereto via a line 26. Thus, master controller 40 provides control signals directly to port drive system 10P and provides acknowledgement signals to auxiliary controller 42 which then provides control signals to starboard drive system 10S.

The feedback signals received by the controllers 40 and 42, besides being processed to achieve drive system control, are also used to operate the visual displays of the display assemblies 36 associated with a respective controller.

Assuming that control station C1 is chosen by actuating the station command switch 104 thereat, that both engines 12 are running and that both control levers 66 are in neutral, the navigator then actuates the mode selector switch knobs 68 to choose troll or cruise mode for each engine 12. In troll mode, the navigator can rotate a knob 68 to operate the associated engine throttle 14 to obtain a desired engine idle speed of up to 1100 rpm, for example. In cruise mode, a predetermined engine idle speed is automatically provided. Having chosen the desired mode, the navigator moves either or both levers 66 in station C1 from neutral to a forward or reverse detent position whereby either or both forward clutches 48 or either or both reverse clutches 52 are selected for operation.

In troll mode, further advancement of a lever 66 in the chosen direction (forward or reverse) from the detent position causes the selected clutch to slippingly engage and allows the respective engine 12 (whose throttle 14 has been set at some predetermined idle speed by the mode selector switch knob 68) to drive respective the propeller shaft 20 (and propeller 22 thereon) at some rotational speed less than the rotational speed of its engine.

In cruise mode, further advancement of a lever 66 in the chosen direction (forward or reverse) from the detent position (wherein the selected clutch became fully engaged) regulates the appropriate engine throttle 14 and its engine 12 drives its respective propeller shaft 20 (and propeller 22) at a rotational speed directly proportional to engine rotational speed.

If display/function selector switch knob 88 is actuated to power-link mode, then both drive systems 10P and 10S operate in response to movement of a single lever 66, whichever is directly associated with the actuated selector switch knob 88, but only in the cruise mode and in the forward direction.

Drive System Control Actuators and Sensing Devices

Referring to FIG. 2, the rotational speed of an engine 12 is regulated by its adjustable throttle 14 which is controlled by proportional modulatable electrical throttle actuator/governor or transducer, such as a proportional solenoid 44 which responds to control signals from a controller 40 or 42 to maintain a selected engine speed. The transducer may, for example, take the form of any one of a number of commercially available prior art units such as described in Dynex/Rivett Inc. SAE Technical Paper 801017 or in Murphy Manufacturer Bulletin AT-7231.

Furthermore, the direction of rotation and rotational speed of a propeller shaft 20 is controlled by the associated clutches 48 and 52. Each clutch 48 and 52 is an electrically operable modulatable clutch having a fully engaged condition, a fully disengaged condition and partially engaged slip conditions therebetween. These clutches may take the form of that described in U.S. Pat. Nos. 4,459,873 or 4,451,238, both assigned to the same assignee as the present application. The clutches 48 and 52 are operated by proportional modulatable electrical clutch actuators or transducers, such as proportional solenoids 46 and 50, respectively, which are responsive to control signals from a controller 40 or 42, to modulate valves (not shown) which vary the clutch application pressure.

Each drive system 10P and 10S is also provided with an engine (transmission input shaft) speed sensing device 60, and with propeller shaft (transmission output shaft) speed sensing device 62. The sensing devices 60 and 62 provide electrical feedback signals representative of or corresponding to the value sensed, i.e., revolutions per minute (RPM), to the associated controller 40 or 42, and from thence to the associated display assembly 36.

Each drive system 10P and 10S is also provided with system condition sensing devices, such as a fluid (cooling water) level sensing device 54; temperature sensing devices 56 for the engine and transmission; and oil pressure sensing devices 58 for the engine and transmission. These condition sensing devices provide electrical feedback signals, proportional to the value sensed, to their respective controllers 40 and 42 and from thence to the associated display assembly 36.

Control Stations

Referring to FIGS. 1 through 4, in each control station C1 and C2 the port control lever assembly 64 and the port mode selector switch assembly 63 are mounted in a common housing H1. The starboard assembly 64 and 63 are mounted in a common housing H2. Each control lever 66 is pivotally mounted on a side of its housing H1 or H2 and mode selector switch knob 68 is rotatably mounted on top of its respective housing. The housings H1 and H2 are closely adjacent and disposed so that the two levers 66 for the port and starboard drive system 10P and 10S are close enough together in side-by-side spaced-apart relationship so that the navigator can move each lever individually so as to control either drive system 10P or 10S independently or so as to grasp both levers to control both drive systems simultaneously. This is a different form of operation than the power-link mode wherein one lever 66 controls both drive systems 10P and 10S simultaneously in forward cruise mode.

Each display assembly 36 is disposed in its own housing alongside the associated housings H1 and H2, respectively, as FIG. 1 best shows.

Direction/Speed Control Assembly

Figure 3:
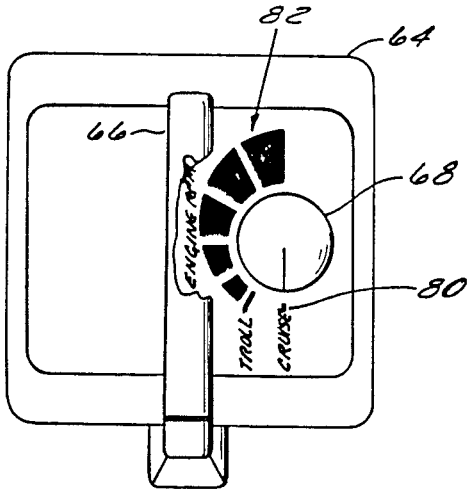
FIG. 3 is an enlarged top plan view of one of the direction/speed control assemblies shown in FIGS. 1 and 2 and shows a mode selector assembly thereon.
Figure 4:
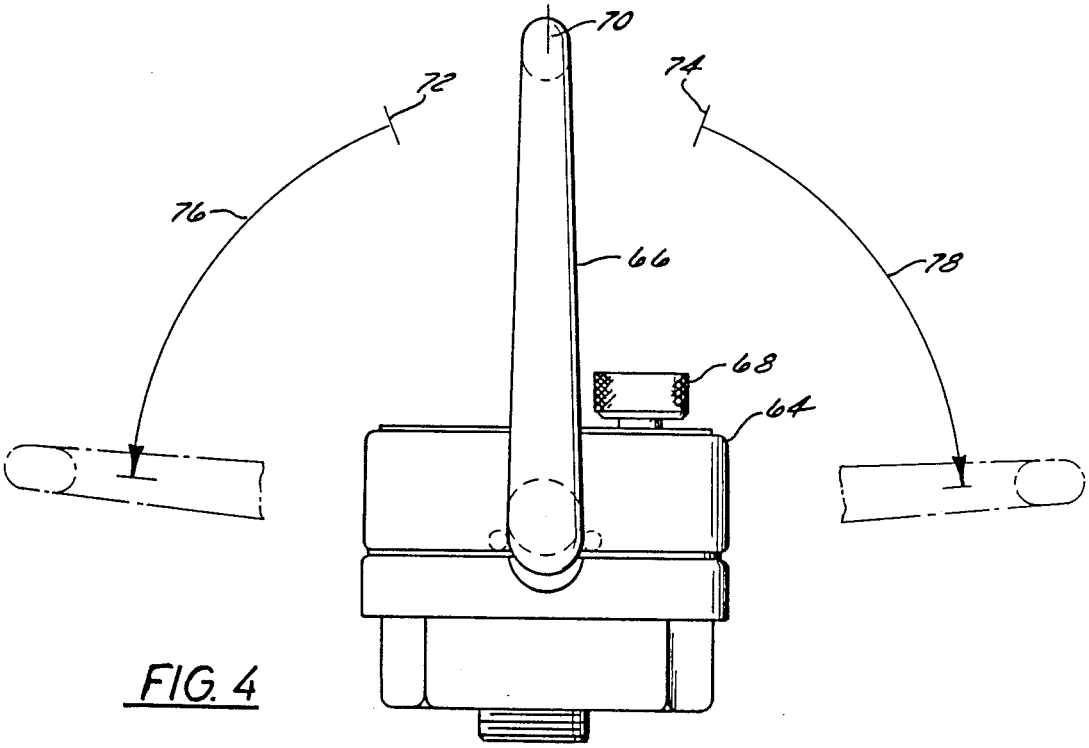
FIG. 4 is an elevation view of one side of the direction/speed control assembly and its direction/speed lever shown in FIG. 3.

FIGS. 3 and 4 are top plan and side elevation views, respectively, of a direction/speed control assembly 64 located in a starboard housing H2 and shows the operating positions of its control lever 66 and its associated mode selector switch knob 68 for selecting the functions to be effected by positioning and movement of control lever 66.

As FIG. 4 shows, each lever 66 has five positions, namely: a centered neutral detent position 70 in which it is depicted; a forward detent position 72; a reverse detent position 74; a forward propeller speed control range 76; and a reverse propeller speed control range 78. The further lever 66 is moved away from neutral in a selected direction, the greater the propeller speed called for. Lever 66 operates a potentiometer (not shown) and a switch (not shown) in assembly 64 to provide electric output signals indicative of detent lever position (neutral, forward, reverse) and of lever position within the propeller speed control ranges 76 and 78.

Mode Selector Assembly

As FIG. 3 shows, mode selector assembly 63 has a mode selector switch knob 68 which has two positions, namely: a cruise mode detent position 80 and a troll mode range 82 in which knob 68 can be rotated to proportionally increase engine speed from slow idle up to a maximum of about 1100 rpm, for example. Knob 68 controls a switch (not shown) and a potentiometer (not shown) located in a housing H1 or H2. Knob 68 can be used, while lever 66 is in neutral, to increase engine idle speed for starting the vessel in motion or for fast idle to provide for engine warm-up or to provide extra power for operating pumps, or electrical generators, or the like. With mode selector switch knob 68 in troll range 82, direction/speed lever 66 still controls the speed of movement of the vessel. This is effected by controlling the amount of clutch slip of the clutches 48 or 52, whichever is selected, in accordance with the position of lever 66 within the speed control ranges 76 or 78. By controlling the amount of clutch slip at a given engine speed, lever 66 controls the speed of a propeller 22 and thus affects vessel speed. If, while in troll mode, the setting of the associated throttle 14 is changed, by rotating mode selector switch knob 68 within troll range 82, the amount of clutch slip is automatically changed in response to control signals from a controller 40 or 42 to maintain the same propeller speed as selected by the position of lever 66.

Display Assembly

Figure 5:
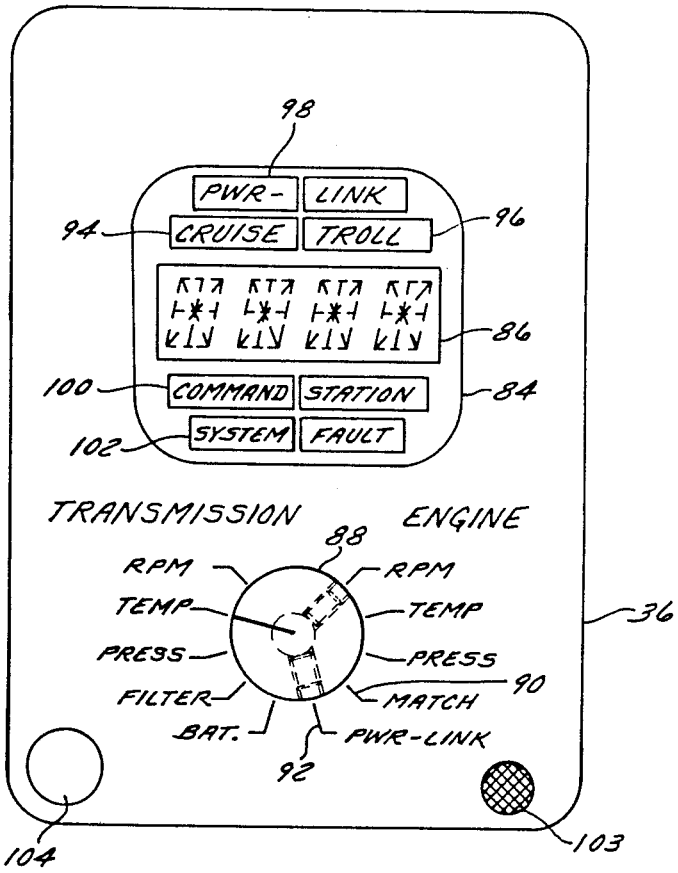
FIG. 5 is an enlarged top plan view of one of the display assemblies shown in FIGS. 1 and 2.

FIG. 5 shows a top plan view of a display assembly 36. Each display assembly 36 comprises a display area 84 and a rotatable display/function selector knob 88 with a pointer 89 thereon. Knob 88 has a plurality of detented positions to which it can be manually rotated by the navigator. Display area 84 encompasses a digital or numerical display window 86, in the form of a liquid crystal display or neon display, capable of displaying information of up to four digits pertaining to transmission or engine conditions called for by the position of selector knob 88 and detected by the sensors 54 (water level); 56 (oil temperature), 58 (oil pressure), 60 (engine shaft speed) and 62 (propeller shaft speed). Display area 84 also encompasses plurality of (four) message bars designated 94, 96, 98, 100 and 102 which contain messages which are visible only when the assembly 36 is powered up by command station switch 104 and a message function has been called for by the position of selector knob 88 or of mode selector knob 68. The respective messages given by double bar 98 is "power-link"; by double bar 94 or 96 is "cruise" or "troll" mode; by double bar 100 is "command station"; and by double bar 102 is "system fault". A system fault indication at double bar 102 could, for example, indicate internal failure of one of the controllers 40 or 42. Energization and illumination of system fault indicator 102 is also accompanied by energization and actuation of an audible alarm 103 located on display assembly 36 to ensure that the navigator is apprised of the system fault.

Command Switch

Means are provided at each control station C1 and C2 for transferring command from one control station to that control station at which command is to be assumed. Such means include the manually operable command switch 104 located at each station. Actuation of switch 104 signals master communications controller 40 that the station at which switch 104 is actuated is to become the command station and is in actual control of the drive systems 10P and 10S. On receipt of the command signal, controller 40 makes the station at which switch 104 was actuated the command station. The command station message bar 100 indicates, when energized and lit, that the station at which it is lit is the command station.

Before the navigator gives a command to change control stations, he may desire to match the position of the control levers and knobs of the station to which he is transferring command to the same position of the control lever and knobs from which command is being transferred. However, it is not necessary to do so. The command switch 104 at a control station C1 and C2 is conveniently mounted on the housing of a display assembly 36 and operates to perform a "take from" function, meaning that a control station can only take control from the current command control station, as opposed to being able to transfer to another station. To take control, the command switch 104 must be actuated, as by depressing or closing. Control transfer can be prevented with the addition of a "lock out" switch (not shown).

If desired, the levers 66 in a station taking command can be moved to a matching position to correspond to the positions of the levers 66 in the control station from which control is being taken actuating the command switch 104. To match the levers 66, display selector knob 88 is turned to "match" position 90 (FIG. 5). The display window 86 will then indicate the command station lever position with the two left-hand characters, and the new command station lever position with the two right-hand characters, for example.

Details of Operation

The navigator chooses the control station C1 or C2 at which he desires to exercise command, places the direction/speed control levers 66 thereat in neutral and actuates the station command switch 104 thereat to enable all functions available at that station.

Of course, if the match function is chosen, when knob 88 is first set to match position 92, the two display assemblies 36 will probably exhibit different data. The operator then moves the control lever 66 at the local station until the two displays match, whereupon command switch 104 is actuated and command is transferred to the local station.

Assuming that both engines 12 are already started and running at low idle speed, the navigator actuates the two mode selector switch knobs 68 at the control station to choose either the troll or cruise mode for each engine. Choosing troll mode and rotating the mode selector switch knob 68 proportionally increases engine speed to a maximum of 1100 rpm, for example, to increase engine speed to that needed for starting the vessel moving or fast idle while the direction/speed control lever 66 is still in neutral. Choosing the cruise mode adjusts engine speed to high idle.

In either mode, initial forward or reverse movement of a direction/speed control lever 66 to detent 72 or 74 causes the appropriate forward or reverse clutch to be chosen.

Thereafter, the effect of further advancement of lever 66 in the chosen direction through the remainder of its travel ranges 76 and 78 depends on whether troll or cruise mode has been selected.

Lever advancement in ranges 76 and 78 in troll mode, at whatever engine speed has been set by rotation of mode selector switch knob 68, enables the direction/speed lever 66 to effect clutch modulation. This enables active control of a propeller shaft 20 (and propeller 22) speed at speeds which are slower than could be otherwise obtainable at engine idle speeds. The propeller shaft speed sensing device 62 provides a shaft speed feedback signal to the appropriate controller 40 or 42 and the latter operates in response thereto to automatically modulate the chosen clutch so that actual propeller shaft speed corresponds to the selected propeller shaft speed, as indicated by the output signal to the controller, which is a function of lever position.

Lever advancement in ranges 76 and 78 in cruise mode enables the direction/speed lever 66 to effect regulation of the engine throttle 14 while the clutch is fully engaged. The engine speed sensing device 60 provides an engine speed feedback signal to the appropriate controller 40 or 42 and the latter operates to provide control signals to automatically regulate the engine throttle 14 so that actual engine speed (which is now the same as propeller shaft speed) corresponds to the selected engine speed, as indicated by the output signal to the controller, which is a function of lever position.

Direction reversals in either troll or cruise mode can be made at any time by appropriate movement of the direction/speed lever 66 and are executed in an automatic timed sequence by the controller 40 or 42. The controller forces the engine throttle 14 to idle speed position prior to engaging that clutch which provides for movement in the opposite direction and then returns the engine throttle 14 to the new speed position called for by the new lever position.

A change can be made from trolling to cruise mode (or vice-versa) at any time by appropriate actuation of the mode selector switch knob 68.

In changing from cruise mode to trolling mode, the engine 12 will decrease speed to that called for by the rotary position of the mode selector switch knob 68, followed by movement of the clutch modulation actuator 46 or 50 to the setting called for by the direction/speed control lever position. In troll mode, the control lever 66 effects clutch modulation rather than engine throttle movement.

In changing from trolling mode to cruise mode, the engine speed will go towards idle, the clutch will fully engage and then the engine speed will ramp to the control lever setting.

Besides the cruise and troll modes above-described, the propulsion system can be operated in the power-link mode by actuation of the knob 88 to the power-link position 92. In the power-link mode, both drive systems 10P and 10S can be controlled to a limited extent by one (port or starboard) set of controls PS or SS in either the main or auxiliary control station C1 or C2, respectively, whichever is chosen as the command station. The power-link mode is available only for forward drive in the cruise mode. The commanding direction/speed control lever 66 must be at forward drive and the slave lever 66 must be at forward idle. Once in the power-link mode, the display selector switch knob 88 may be moved to any other display position without affecting the power-link mode. Exit from this mode is accomplished either by movement of the commanding lever 66 to neutral or reverse or out of drive or by any movement of the slave lever 66 out of its forward detent position.

The communications controller 40 and 42 include means for providing the power-link feature. The power-link feature is engaged by first placing the appropriate lever 66 in the forward detent position 72 (FIG. 4), and then setting the knob 88 to the power-link position 92. The power-link message bar 98 is then illuminated. When in power-link mode, the master lever 66 is in the forward drive detent position and controls the engines and transmissions but the slave lever 66 is in forward idle.

The power-link mode facilitates control of the vessel and makes it easier to synchronize control of the separate engines and transmissions so as to avoid loss of power due to unbalanced power application due to different throttle settings for the several engines, for instance. Once power-link is achieved, knob 88 may be moved to any position to allow an operator to monitor any condition without losing power-link. To disengage power-link, the operator merely needs to move the lever which had been in the forward detent position 72 to any other position. When the lever is moved, it regains control of its respective engine and transmission.

Neutral start and neutral disconnect features are tied in directly with the direction/speed control levers. Neutral start forces the direction/speed control levers to be in the neutral position in order to allow the engine to be started. Neutral disconnect occurs also when the direction/speed control lever is in neutral, and its function is to remove all power from the transmission electric clutch control valves.

I claim:

1. A marine propulsion system comprising:

a propeller drive shaft;

an engine having an engine throttle operable to regulate engine speed;

engine throttle control means;

a transmission, having forward and reverse clutches operable to connect said engine to said propeller drive shaft for rotation in forward and reverse directions, said clutch being modulatable to regulate the speed of said propeller drive shaft;

clutch control means;

and control means for operating said engine throttle control means and said clutch control means to effect rotation of said engine at a selected speed; and to effect rotation of said propeller drive shaft in forward or reverse directions and at a selected speed, said control means comprising:

mode selector means for operating said engine throttle to effect operation of said engine at a selected speed, one selected speed being a relatively slow troll speed and another selected speed being a relatively faster cruise speed, said mode selector means providing output signals indicative that troll speed or cruise speed is selected; and direction/speed control means for selecting one of said clutches to effect rotation of said propeller drive shaft in forward or reverse direction, said direction/speed control means being further operable when said troll speed has been selected to modulate the selected clutch to enable propeller shaft rotation at a troll speed less than said selected engine speed, said direction/speed control means being further operable when said cruise speed has been selected to effect full clutch engagement and to operate said engine throttle to enable propeller shaft rotation at a cruise speed proportional to engine speed, said direction/speed control means providing output signals indicative of the direction and speed selected for said propeller shaft;

said control means further comprising:

sensing means for providing feedback signals indicative of engine speed and of propeller shaft speed and direction of shaft rotation;

and controller means for receiving and processing said output signals and said feedback signals and for providing control signals to effect operation of said engine throttle control means and said clutch control means.

2. A marine propulsion system for a vessel comprising:

a propeller drive shaft;

an engine having an engine throttle;

a transmission having forward and reverse clutches operable to connect said engine to said propeller drive shaft for rotation in forward and reverse directions;

and control means for operating said engine throttle and said clutches and comprising:

a control station having a set of control devices for providing electric output signals indicative of selected engine speed, propeller shaft speed and direction of propeller shaft rotation;

sensing devices for providing electric feedback signals indicative of actual engine speed, propeller shaft speed and direction of propeller shaft rotation;

and electronic controller means for receiving and processing said output signals and said feedback signals and for providing control signals to operate said engine throttle and said clutches.

3. A marine propulsion system according to claim 2 wherein said control station is portable and is locatable at a plurality of different locations on board said vessel.

4. A marine propulsion system according to claim 2 wherein said control means comprises a plurality of said control stations, and wherein each control station has a command control device actuatable for providing an electric output signal to said electronic controller means to enable only that set of control devices at a control station whereat said command control device is actuated to provide effective electric output signals to said electronic controller means.

5. A marine propulsion system according to claim 4 wherein each of said control stations has a display assembly thereat which is connected to said controller means and provides data pertaining to engine speed, and to propeller shaft speed and to the position of a set of controls at another control station.

6. A marine propulsion system comprising:

a plurality of propellers;

a plurality of engines each having an engine throttle operable to regulate engine speed;

engine throttle control means;

a plurality of transmissions, each having clutches therein operable to connect its respective engine to a respective propeller for rotation in forward and reverse directions, each clutch being modulatable to regulate the speed of rotation of its respective propeller;

clutch control means;

and control means for operating said engine throttle control means and said clutch control means to effect:

rotation of each engine at a selected speed; and rotation of each propeller in forward or reverse directions and at a selected speed, said control means comprising:

mode selector means for operating an engine throttle to effect operation of its respective engine at a selected speed, one selected speed being a relatively slow troll speed and another selected speed being a relatively faster cruise speed, said mode selector means providing output signals indicative that troll speed or cruise speed is selected; and direction/speed control means for operating the clutches in a transmission to effect rotation of its respective propeller in forward or reverse direction for both troll speed and cruise speed, said direction/speed control means being further operable to modulate an active clutch during troll speed to enable propeller rotation at a speed less than its associated engine speed, said direction/speed control means providing output signals indicative of the direction and speed selected for a propeller;

and wherein said control means further comprises;

sensing means for providing feedback signals indicative of engine speed and of propeller speed and direction of rotation;

and controller means for receiving and processing said output signals and said feedback signals for providing control signals to operate said engine throttle control means and said clutch control means.

7. A marine propulsion system for a vessel comprising:

a plurality of drive systems, each comprising an engine having an engine throttle and a transmission having modulatable forward and reverse clutches for connecting the engine to drive a propeller;

and a control means for operating said engine throttle and said clutches in each of said drive systems and comprising:

a control station positionable at a location on said vessel and comprising a plurality of sets of control devices, one set for each drive system, each set comprising a manually operable mode selector device actuatable to select a slow troll mode or a relatively faster cruise mode for the throttle of its respective drive system, each set further comprising a manually operable direction/speed control device actuatable to select one of the clutches in its respective drive system, said direction/speed control device being further actuatable, when troll mode is selected, to effect modulation of the selected clutch to achieve propeller rotation at speeds lower than engine speed, said direction/speed control device being further actuatable, when cruise mode is selected, to effect full engagement of the selected clutch and regulation of the engine throttle in its respective drive system to achieve propeller rotation at speeds proportional to engine speed, each set of control devices further comprising a manually operable function selector device actuatable to select a power-link function whereby the direction/speed control device in the same set is enabled to effect simultaneous regulation of the engine throttles in more than one drive system, said simultaneous regulation of engine throttles being effected only when the mode selector device in the said same set selects cruise mode and the direction/speed device in the same set effects engagement of the forward clutch.

8. A marine propulsion system according to claim 7 wherein said control means comprises a plurality of control stations, each at a different location onbaord said vessel, and wherein each control station comprises a manually actuatable command device which, when actuated, enables only the sets of control devices in the control station whereat the command device is actuated to effect control of the drive systems and prevents such control from being effected by other control stations.

9. A marine propulsion system comprising:

a pair of propeller drive shafts;

a pair of engines each having an electrically controlled engine throttle operable to regulate engine speed; a pair of transmissions, each having electrically controlled clutches therein operable to connect its respective engine to a respective propeller drive shaft for rotation in forward and reverse directions and modulatable to regulate the speed of rotation of its respective propeller drive shaft;

and control means for operating said engine throttles and said clutches and comprising:

mode selector means for operating each engine throttle to effect operation of its respective engine in troll mode or cruise mode, said mode selector means providing electric output signals indicative of the mode selected;

and direction/speed control means for operating said clutches to effect rotation of its respective propeller drive shaft in forward or reverse direction and, said direction/speed control means being further operable in troll mode to effect clutch modulation, and in cruise mode to effect full clutch engagement and operation of an engine throttle, said direction/speed control means providing electric output signals indicative of the direction and speed of rotation selected for a propeller drive shaft;

and wherein said control means further comprises:

sensing means for providing electric feedback signals indicative of engine speed and propeller shaft direction of rotation and speed;

an electronic controller means for receiving and processing said output signals and said feedback signals for providing control signals to operate said engine throttles and said clutches.

10. In a propulsion system for a vessel:

port and starboard drive systems comprising port and starboard propeller drive shafts;

port and starboard engines;

port and starboard engine throttles operable to control the speed of said port and starboard engines, respectively; and port and starboard transmissions for transmitting drive power from said port and starboard engines, respectively, to said port and starboard propeller drive shafts, respectively, each transmission comprising a forward clutch and a reverse clutch, each clutch being operable to assume a fully engaged condition, a fully disengaged condition, and clutch slip conditions therebetween; and control means for operating said engine throttles and said clutches to control the speed and direction of said vessel, said control means comprising a control station positionable at a location on said vessel, said control station comprising:

manually operable port and starboard mode selector devices actuatable to provide mode output signals indicative that a cruise mode or a troll mode is selected for the port and starboard drive systems, respectively;

manually operable port and starboard direction/speed control levers actuatable to provide direction and speed output signals indicative that a forward or reverse direction and a desired speed is selected for the port and starboard drive systems, respectively;

sensing devices for providing feedback signals indicative of the output speed of each engine and indicative of the direction of rotation and rotational speed of each propeller drive shaft;

and electronic controller means for receiving and operating upon said output signals and said feedback signals and to provide control signals to operate said engine throttles and said clutches.

11. A propulsion system according to claim 10 wherein said control station further comprises a manually operable power link selector device actuatable to provide a power link output signal to said electronic controller means to enable one of said port and starboard direction/speed control levers to effect simultaneous control of both drive systems.

12. In a marine propulsion system:

port and starboard drive systems;

each drive system comprising an engine having an engine throttle and a transmission comprising forward and reverse modulatable clutches for connecting said engine to a propeller drive shaft;

and control means for said drive systems comprising:

a control station having two sets of controls, one set for each drive system, each set comprising a mode selector means for controlling the engine throttle of its respective drive system in any one of a plurality of modes, each set further comprising a direction/speed selector means for controlling the clutches and the engine throttle of its respective drive system, each of said means providing electric output signals indicative of the selection being made;

sensing devices for providing electric feedback signals indicative of the rotational speed of the engine and the rotational direction and rotational speed of the propeller drive shaft of each drive system;

and electronic controller means for receiving and processing said electric output signals and said feedback signals and for providing control signals to effect operation of the engine throttles and the clutches in accordance therewith.

13. A marine propulsion system according to claim 12 wherein a set of controls includes power-link selector means operable to provide an electric power-link output signal to said electronic controller means to enable the direction/speed selector means for a respective drive system to effect operation of both drive systems simultaneously and in unison.

14. A marine propulsion system according to claim 12 or 13 wherein said electronic controller means comprises a master controller and an auxiliary controller which are electrically connected to each other, each controller being further connected to receive input signals and feedback signals from and provide control signals to a respective drive system.

15. A marine propulsion system according to claim 13 wherein said electronic controller means comprises a master controller and an auxiliary controller which are electrically connected to each other, each controller being further connected to receive input signals and feedback signals from and provide control signals to a respective drive system, and wherein said power-link selector means provides said power-link output signal directly to said main controller so that said main controller receives message signals from said auxiliary controller pertaining to the input signals and feedback signals received by said auxiliary controller and provides acknowledgment signals to said auxiliary controller to effect operation of the respective drive system associated with said auxiliary controller.

16. A marine propulsion system according to claim 15 wherein said control station comprises display assembly means including visual display means and a manually operable display selector device for selecting data to be presented by said visual display means, said display assembly being electrically connected to said electronic controller means for receiving and displaying data pertaining to conditions in said port and starboard drive systems.

17. A marine propulsion system according to claim 16 wherein said display assembly means comprises an individual display unit for each set of controls in said control station.

18. A marine propulsion system according to claim 16 wherein said power-link selector means is embodied in said display assembly means and is actuatable by said manually actuatable display selector device.

19. A marine propulsion system according to claim 1 or 6 wherein;

said engine throttle is electrically controlled;

said clutches are electrically controlled;

said output signals are electric;

said feedback signals are electric;

said controller means are electric;

and said control signals are electric;

* * * * *